US011720049B2

(12) United States Patent
Itabashi et al.

(10) Patent No.: US 11,720,049 B2
(45) Date of Patent: Aug. 8, 2023

(54) DEVELOPING CARTRIDGE INCLUDING FIRST CAM ROTATABLE WITH FIRST GEAR AND SECOND CAM ROTATABLE WITH SECOND GEAR TO SEPARATE DEVELOPING ROLLER FROM PHOTOSENSITIVE DRUM

(71) Applicant: BROTHER KOGYO KABUSHIKI KAISHA, Nagoya (JP)

(72) Inventors: Nao Itabashi, Nagoya (JP); Atsushi Fukaya, Toyohashi (JP); Naoya Kamimura, Ichinomiya (JP); Daisuke Maeta, Nagoya (JP); Keigo Nakajima, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/745,159

(22) Filed: May 16, 2022

(65) Prior Publication Data

US 2022/0404759 A1 Dec. 22, 2022

(30) Foreign Application Priority Data

Jun. 22, 2021 (JP) ..... 2021-102982

(51) Int. Cl.
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1821* (2013.01)

(58) Field of Classification Search
CPC ..... G03G 21/1647; G03G 21/1676; G03G 21/1821; G03G 2221/1651
See application file for complete search history.

(56) References Cited

U.S. PATENT DOCUMENTS

2017/0184998 A1 6/2017 Itabashi
2021/0223713 A1* 7/2021 Ikegami ..... G03G 21/1676
2022/0171323 A1* 6/2022 Hatano

FOREIGN PATENT DOCUMENTS

JP 2017-116826 A 6/2017

* cited by examiner

*Primary Examiner* — Sophia S Chen
(74) *Attorney, Agent, or Firm* — Merchant & Gould P.C.

(57) ABSTRACT

A developing cartridge includes: a developing roller rotatable about an axis extending in a first direction; a casing; a first cam and a first gear rotatable together relative to the casing about a first axis extending in the first direction; and a second cam and a second gear rotatable together relative to the casing about a second axis extending in the first direction. The second gear contacts the first gear. When the developing cartridge is attached to a drum cartridge including a photosensitive drum: at a first position of the first cam, the second cam is at a third position and the developing roller and the photosensitive drum contact each other; and at a second position of the first cam, the second cam is at a fourth position and contacts a part of the drum cartridge to move the developing cartridge to separate the developing roller from the photosensitive drum.

17 Claims, 9 Drawing Sheets

DEVELOPING CARTRIDGE INCLUDING FIRST CAM ROTATABLE WITH FIRST GEAR AND SECOND CAM ROTATABLE WITH SECOND GEAR TO SEPARATE DEVELOPING ROLLER FROM PHOTOSENSITIVE DRUM

CROSS REFERENCE TO RELATED APPLICATIONS

This application claims priority from Japanese Patent Application No. 2021-102982 filed Jun. 22, 2021. The entire content of the priority application is incorporated herein by reference.

BACKGROUND

There has been known an electrophotographic-type image forming apparatus such as a laser printer and an LED printer. The image forming apparatus employs a developing cartridge. The developing cartridge includes a developing roller for supplying developing agent.

A conventional developing cartridge is configured to be attached to a drum cartridge. The drum cartridge includes a photosensitive drum. Upon attachment of the developing cartridge to the drum cartridge, the photosensitive drum and the developing roller make contact with each other. The drum cartridge to which the developing cartridge is attached is configured to be attached to an image forming apparatus.

SUMMARY

In the above-described conventional image forming apparatus, a so-called separating operation may be performed for temporarily separating the developing roller from the photosensitive drum. In the separating operation, the developing cartridge is moved relative to the drum cartridge by a pressing force applied from the image forming apparatus. However, in a case where the pressing force from the image forming apparatus is to be applied to the developing cartridge through a part of the drum cartridge, the number of parts or components of the drum cartridge may inevitably increase.

In view of the foregoing, it is an object of the disclosure to provide a structure that enables the developing roller to move in a direction away from the photosensitive drum by a part or a component of the developing cartridge.

In order to attain the above and other object, according to one aspect, the present disclosure provides a developing cartridge attachable to a drum cartridge including a photosensitive drum. The developing cartridge includes: a developing roller rotatable about a developing axis extending in a first direction; a casing configured to accommodate developing agent therein; a first cam rotatable relative to the casing about a first axis extending in the first direction between a first position and a second position; a first gear rotatable about the first axis together with the first cam; and a second cam rotatable relative to the casing about a second axis extending in the first direction between a third position and a fourth position; a second gear rotatable about the second axis together with the second cam. The casing has one end in a second direction where the developing roller is positioned. The second gear is in contact with the first gear. In a state where the developing cartridge is attached to the drum cartridge, in a case where the first cam is at the first position, the second cam is at the third position to cause a surface of the developing roller and a surface of the photosensitive drum to contact each other. In the state where the developing cartridge is attached to the drum cartridge, in a case where the first cam is at the second position, the second cam is at the fourth position to make contact with a part of the drum cartridge such that the developing cartridge moves relative to the drum cartridge in a direction to separate the surface of the developing roller from the surface of the photosensitive drum in such a manner that a point of contact between the second cam and the part of the drum cartridge functions as a fulcrum.

With this structure, the developing roller can be moved in a direction away from the photosensitive drum by the rotations of the first cam and the second cam provided in the developing cartridge.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, an embodiment of the present disclosure will be described with reference to the accompanying drawings.

In the following description, a developing roller 30 of a developing cartridge 1 will be assumed to extend in a "first direction". Further, a direction which one end and another end of a casing of the developing cartridge 1 are arranged will be referred to as a "second direction." Here, the developing roller 30 is positioned at the one end and the other end is opposite to the one end. The first direction and the second direction cross each other, and preferably, the first direction and the second direction be perpendicular to each other.

<Embodiment>

1. Structure of the Developing Cartridge

Figure 1:
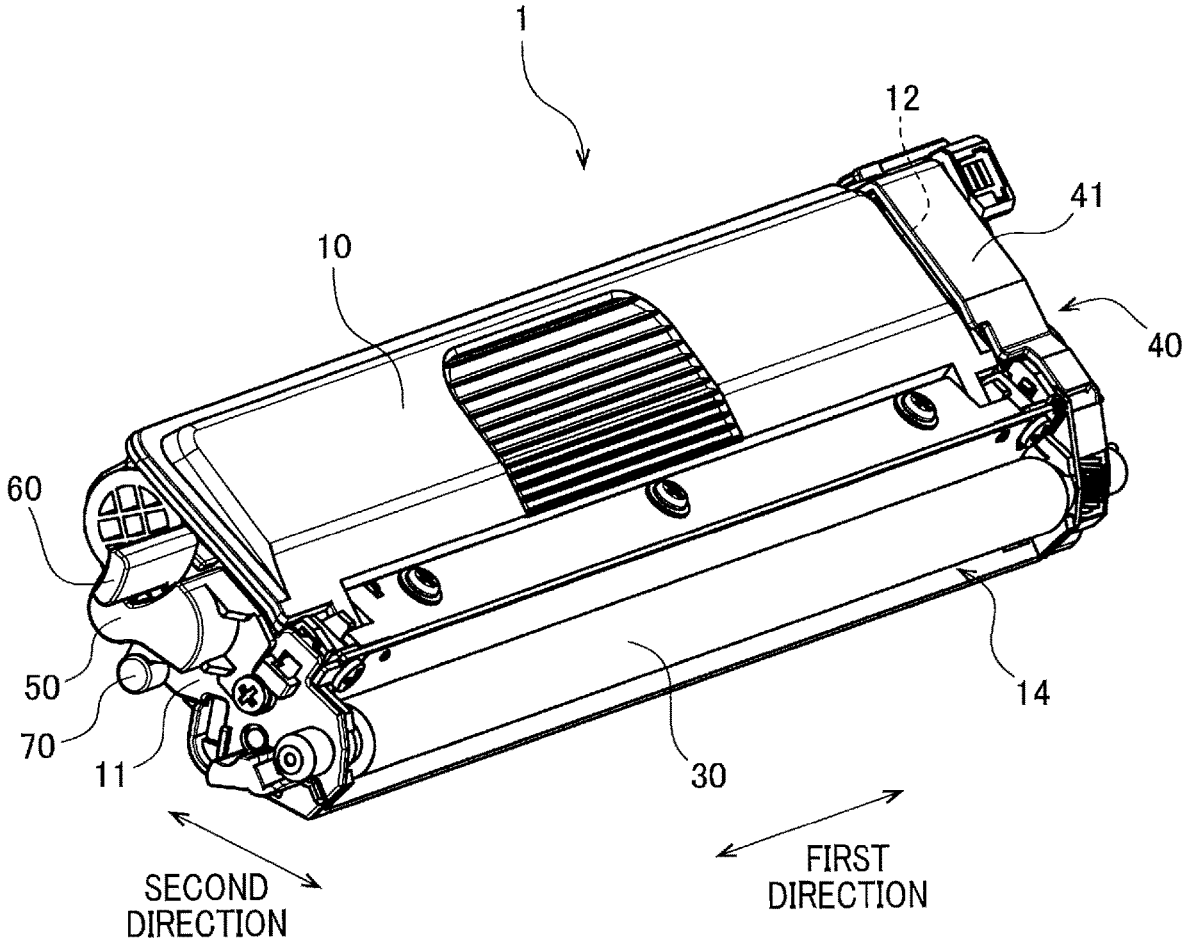
FIG. 1 is a perspective view of a developing cartridge.
Figure 2:
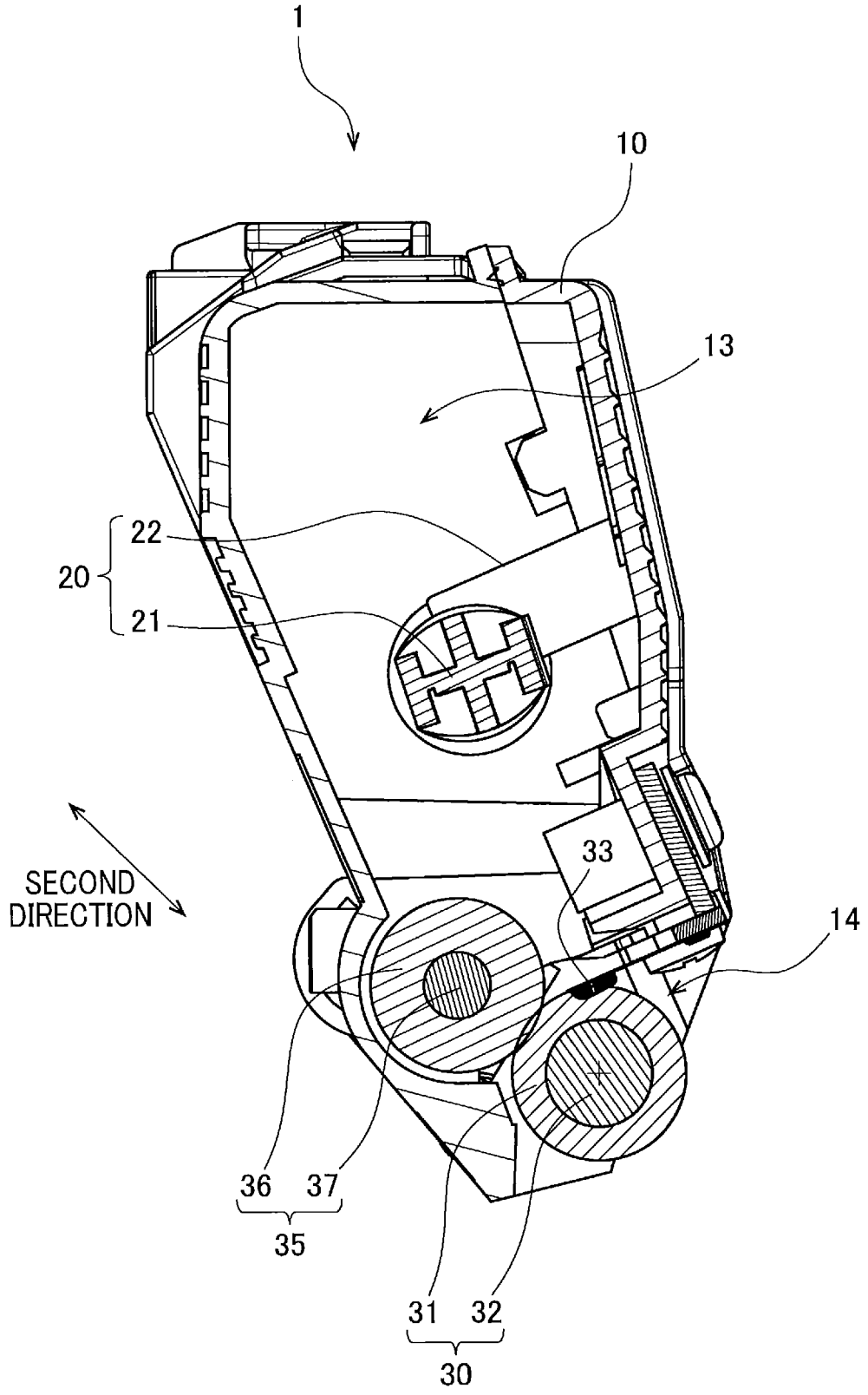
FIG. 2 is a cross-sectional view of the developing cartridge.
Figure 3:
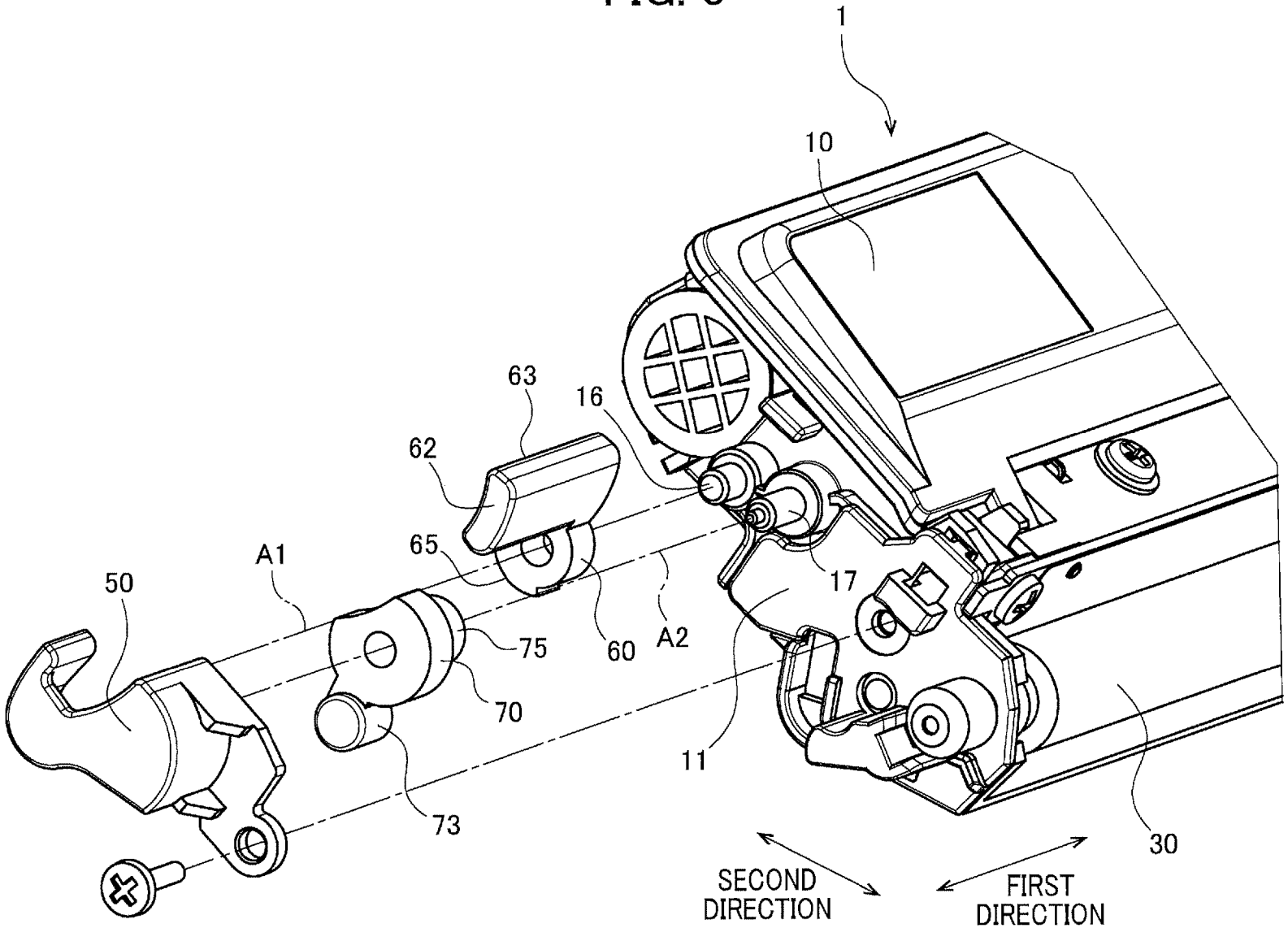
FIG. 3 is a partially-enlarged exploded perspective view of the developing cartridge.

FIG. 1 is a perspective view of a developing cartridge 1. FIG. 2 is a cross-sectional view of the developing cartridge 1 taken along a plane perpendicular to the first direction. FIG. 3 is a partially-enlarged exploded perspective view of the developing cartridge 1.

The developing cartridge 1 is used together with a drum cartridge 2 (FIG. 7, described later) in an electrophotographic-type image forming apparatus, such as a laser printer and an LED printer. The developing cartridge 1 is attachable to the drum cartridge 2. Further, the developing cartridge 1 is attachable to the image forming apparatus in a state where the developing cartridge 1 is attached to the drum cartridge 2.

For example, four developing cartridges 1 are attachable to the image forming apparatus. The four developing cartridges 1 respectively accommodate therein developing agent (toner) of different colors (for example, cyan, magenta, yellow, and black). The image forming apparatus is configured to form an image on a recording surface of a printing sheet by the developing agent supplied from the respective developing cartridges 1. Incidentally, the number of the developing cartridges 1 attachable to the image forming apparatus need not be four, but may be one through three, or five or more.

As illustrated in FIGS. 1 through 3, the developing cartridge 1 includes a casing 10, an agitator 20, the developing roller 30, a supply roller 35, a gear portion 40, a cam cover 50, a first cam 60, a first gear 65, a second cam 70, and a second gear 75.

The casing 10 illustrated in FIGS. 1 through 3 is configured to accommodate developing agent therein. The casing 10 has a first outer surface 11 and a second outer surface 12. The first outer surface 11 is positioned at one end of the casing 10 in the first direction. The second outer surface 12 is positioned at another end of the casing 10 in the first direction. The first outer surface 11 and the second outer surface 12 are spaced apart from each other in the first direction. The casing 10 extends in the first direction between the first outer surface 11 and the second outer surface 12. The casing 10 also extends in the second direction.

An accommodation chamber 13 is defined in an interior of the casing 10. The developing agent is accommodated in the accommodation chamber 13. The casing 10 has an opening 14. The opening 14 is positioned at one end of the casing 10 in the second direction. The accommodation chamber 13 is in communication with an outside of the casing 10 through the opening 14. Incidentally, a handle may be provided at an outer surface of another end portion of the casing 10 in the second direction.

As illustrated in FIG. 2, the agitator 20 includes an agitator shaft 21 and a fin 22. The agitator shaft 21 extends in the first direction. The fin 22 extends from the agitator shaft 21 toward an inner surface of the casing 10. That is, the fin 22 extends radially outwardly from the agitator shaft 21. A portion of the agitator shaft 21 and the fin 22 are disposed in the accommodation chamber 13 of the casing 10. The agitator shaft 21 has one end portion in the first direction to which an agitator gear is fixed. The agitator gear is one of the constituents of the gear portion 40. As the agitator gear rotates, the agitator shaft 21 and the fin 22 rotate about a rotation axis extending in the first direction. Accordingly, the developing agent accommodated in the accommodation chamber 13 is configured to be agitated by the rotation of the fin 22.

The developing roller 30 illustrated in FIGS. 1 through 3 is rotatable about a rotation axis (developing axis) extending in the first direction. The developing roller 30 is positioned at the opening 14 of the casing 10. That is, the developing roller 30 is positioned at the one end of the casing 10 in the second direction.

The developing roller 30 includes a developing roller body 31 and a developing roller shaft 32. The developing roller body 31 is a hollow cylindrical member extending in the first direction. The developing roller body 31 is made from an elastic material such as rubber. The developing roller shaft 32 is a solid cylindrical member extending in the first direction throughout a length of the developing roller body 31. The developing roller shaft 32 has an electrically conductive property. The developing roller shaft 32 is made from metal or electrically conductive resin.

The developing roller body 31 is fixed to the developing roller shaft 32. The developing roller shaft 32 has one end portion in the first direction to which a developing-roller gear is fixed. The developing-roller gear is one of the constituents of the gear portion 40. As the developing-roller gear rotates, the developing roller shaft 32 also rotates, thereby causing the developing roller body 31 to rotate together with the developing roller shaft 32.

Incidentally, the developing roller shaft 32 may not extend throughout the length of the developing roller body 31 in the first direction. For example, a developing roller shaft may extend outward from each end portion of the developing roller body 31 in the first direction.

In a case where the drum cartridge 2 to which the developing cartridge 1 is attached is attached to the image forming apparatus, a bias voltage is supplied to the developing roller shaft 32 from the image forming apparatus. Accordingly, due to an electrostatic force generated between the developing roller shaft 32 and the developing agent, the developing agent is carried on an outer peripheral surface of the developing roller body 31.

The supply roller 35 illustrated in FIG. 2 is rotatable about a rotation axis extending in the first direction. The supply roller 35 is positioned between the agitator 20 and the developing roller 30. The supply roller 35 includes a supply roller body 36 and a supply roller shaft 37. The supply roller body 36 is a hollow cylindrical member extending in the first direction. The supply roller body 36 is made from an elastic material such as rubber. The supply roller shaft 37 is a solid cylindrical member extending in the first direction throughout a length of the supply roller body 36. The supply roller shaft 37 has an electrically conductive property. The supply roller shaft 37 is made from metal or electrically conductive resin.

The supply roller body 36 is fixed to the supply roller shaft 37. The supply roller shaft 37 has one end portion in the first direction to which a supply-roller gear is fixed. The supply-roller gear is one of the constituents of the gear portion 40. As the supply-roller gear rotates, the supply roller shaft 37 also rotates, thereby causing the supply roller body 36 to rotate together with the supply roller shaft 37.

Incidentally, the supply roller shaft 37 may not extend throughout the length of the supply roller body 36 in the first direction. For example, a supply roller shaft may extend from each end portion of the supply roller body 36 in the first direction.

In the case where the drum cartridge 2 to which the developing cartridge 1 is attached is attached to the image forming apparatus, a bias voltage is supplied to the supply roller shaft 37 from the image forming apparatus. Accordingly, due to an electrostatic force generated between the supply roller shaft 37 and the developing agent, the developing agent is carried on an outer peripheral surface of the supply roller body 36.

As illustrated in FIG. 2, the outer peripheral surface of the developing roller body 31 and the outer peripheral surface of the supply roller body 36 are in contact with each other. As the developing roller 30 and the supply roller 35 rotate, the developing agent inside the casing 10 is supplied to the developing roller 30 by way of the supply roller 35.

The developing cartridge 1 further includes a layer thickness regulation blade 33. The layer thickness regulation blade 33 is configured to regulate a thickness of the developing agent layer carried on the outer peripheral surface of the developing roller body 31 into a constant thickness.

The developing agent carried on the outer peripheral surface of the developing roller body 31 is then supplied to a photosensitive drum 92 (described later) of the drum cartridge 2. At this time, the developing agent is transferred from the developing roller body 31 onto an outer peripheral surface of the photosensitive drum 92 in conformance with an electrostatic latent image formed on the outer peripheral surface of the photosensitive drum 92. In this way, the electrostatic latent image is developed into a visible image on the outer peripheral surface of the photosensitive drum 92.

As illustrated in FIG. 1, the gear portion 40 is positioned at the second outer surface 12 of the casing 10. The gear portion 40 includes a plurality of gears including the agitator gear, the developing-roller gear, and the supply-roller gear described above. The gear portion 40 further includes a coupling (not shown) and a gear cover 41. The gear cover 41 is fixed to the second outer surface 12 of the casing 10 by, for example, screws. At least a part of the plurality of gears is positioned between the second outer surface 12 and the gear cover 41 in the first direction.

In the case where the developing cartridge 1 attached to the drum cartridge 2 is attached to the image forming apparatus, a drive shaft (not shown) of the image forming apparatus is connected to the coupling of the gear portion 40. Accordingly, the rotation of the drive shaft is configured to be transmitted, through the coupling, to the agitator gear, the developing-roller gear, and the supply-roller gear.

Incidentally, the plurality of gears of the gear portion 40 may be configured to transmit the rotation force by meshing engagement between gear teeth, or by a friction force between neighboring members.

Figure 4:
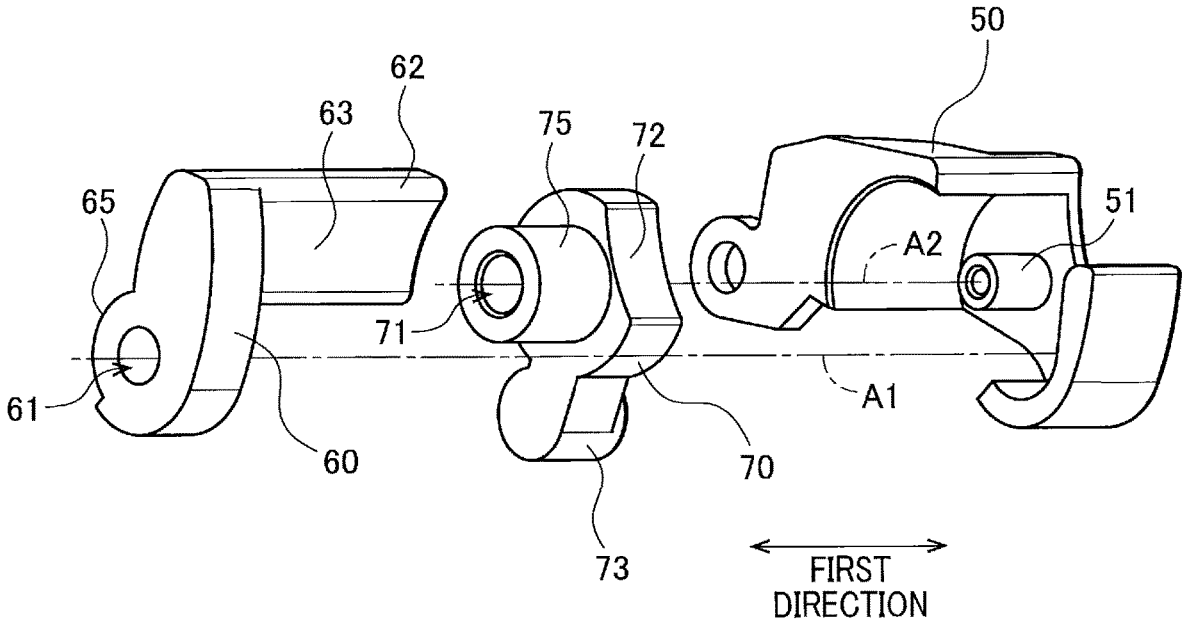
FIG. 4 is an exploded perspective view of a cam cover, a first cam, a first gear, a second cam, and a second gear.
Figure 5:
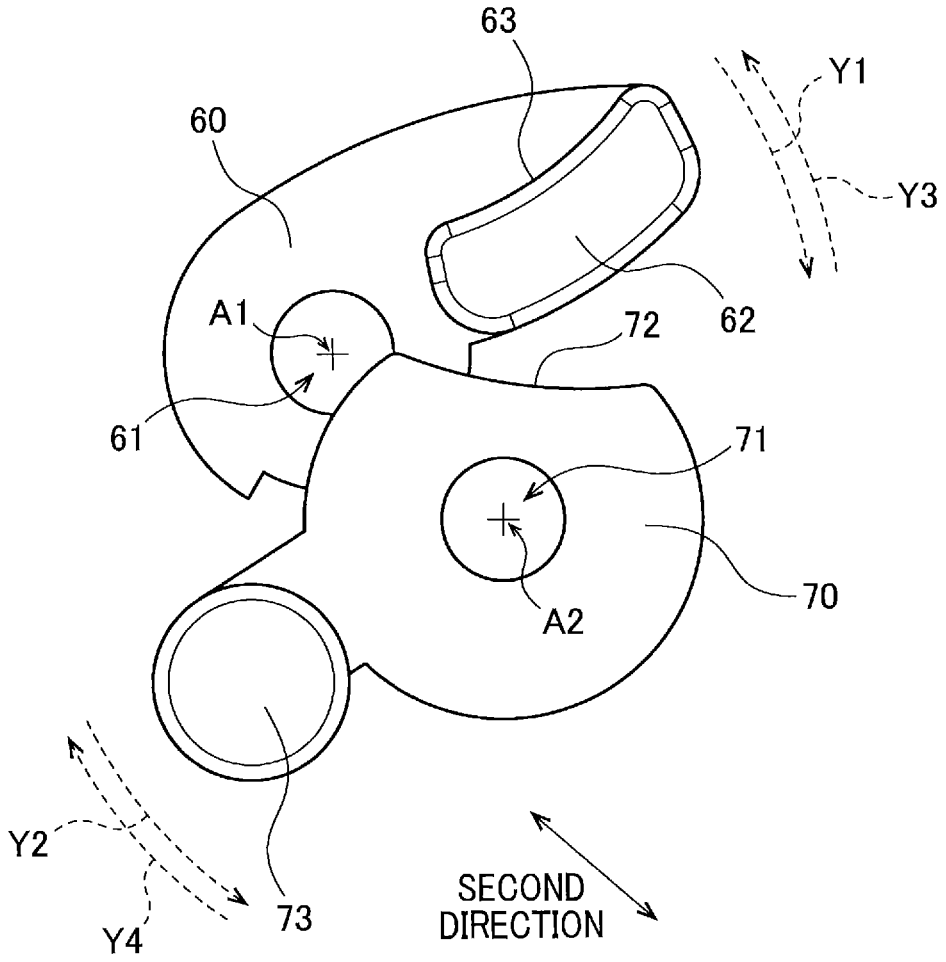
FIG. 5 is a plan view of the first cam and the second cam as viewed in a first direction.
Figure 6:
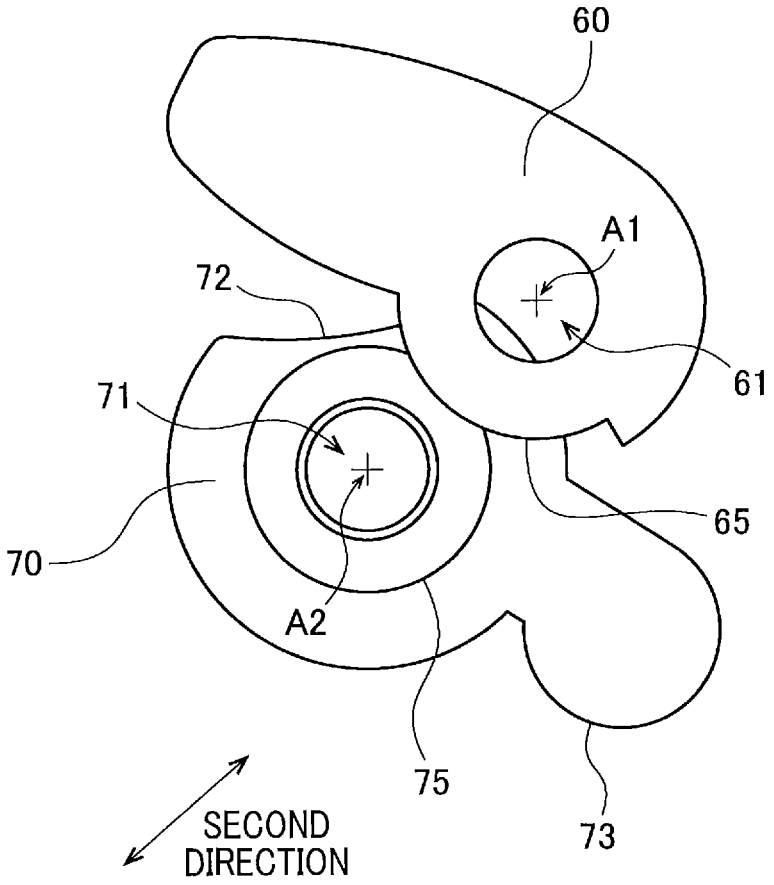
FIG. 6 is another plan view of the first cam and the second cam as viewed in the first direction.

FIG. 4 is an exploded perspective view of the cam cover 50, the first cam 60, the first gear 65, the second cam 70, and the second gear 75. FIG. 5 is a plan view of the first cam 60 and the second cam 70 as viewed in the first direction from the cam cover 50 side. FIG. 6 is a plan view of the first cam 60 and the second cam 70 as viewed in the first direction from the casing 10 side.

As illustrated in FIGS. 3 and 4, the cam cover 50 is positioned at one end of the casing 10 in the first direction. The cam cover 50 is fixed to the first outer surface 11 by, for example, a screw. The cam cover 50 covers a part of the first cam 60 and a part of the second cam 70. Specifically, the cam cover 50 covers the first gear 65 and the second gear 75. That is, the first gear 65 and the second gear 75 are positioned between the first outer surface 11 and the cam cover 50 in the first direction.

The first cam 60 illustrated in FIGS. 3 through 6 is configured to receive a pressing force from the image forming apparatus to perform a separating operation (described later) in the state where the developing cartridge 1 attached to the drum cartridge 2 is attached to the image forming apparatus. The first cam 60 is positioned at the one end of the casing 10 in the first direction. More specifically, the first cam 60 is positioned at the first outer surface 11 of the casing 10. Further, the first cam 60 is positioned farther from the developing roller 30 than the second cam 70 is from the developing roller 30 in the second direction.

Figure 8:
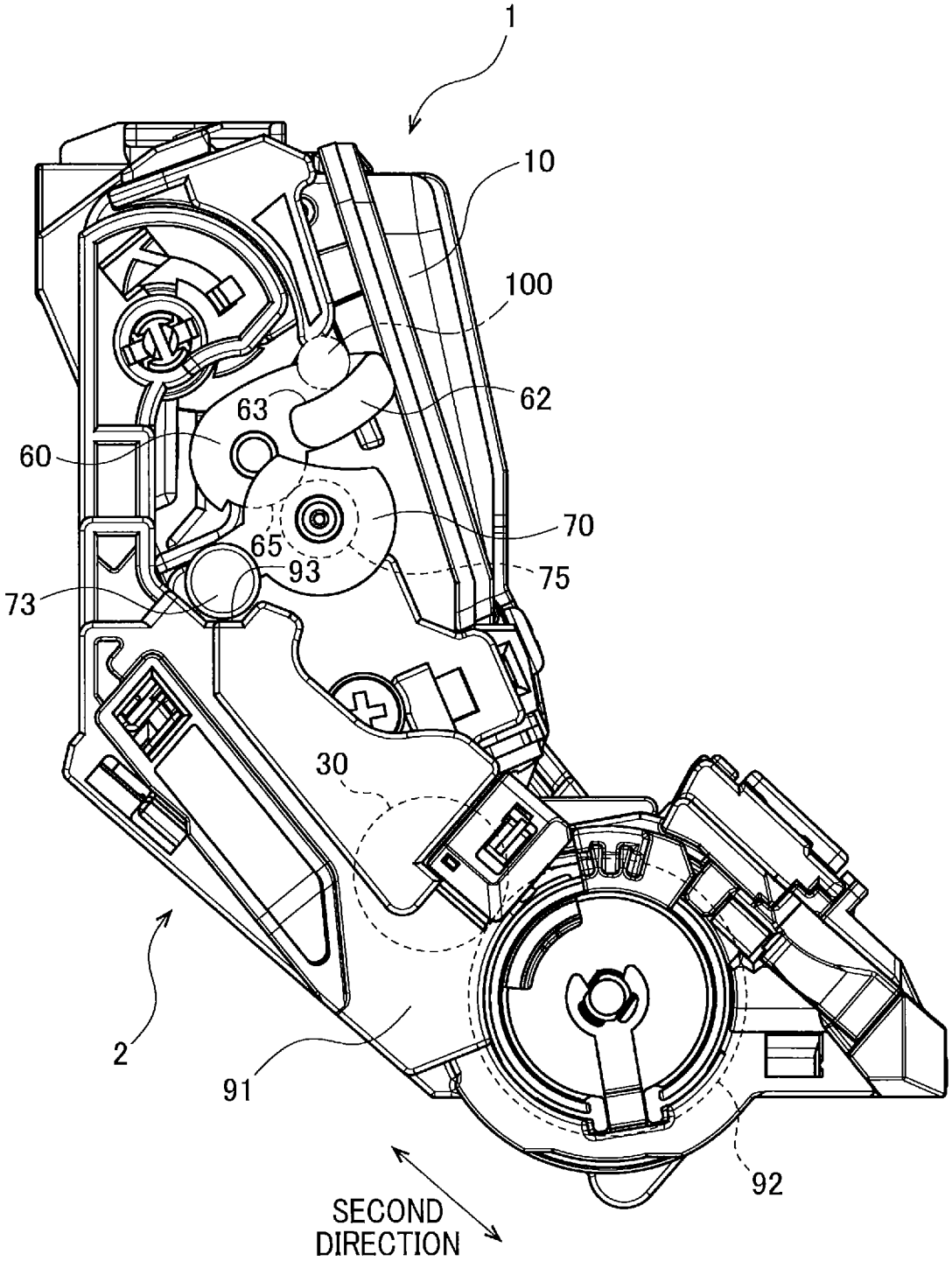
FIG. 8 is a plan view of the developing cartridge and the drum cartridge as viewed in the first direction, and particularly illustrating a state where a separating operation is not performed.
Figure 9:
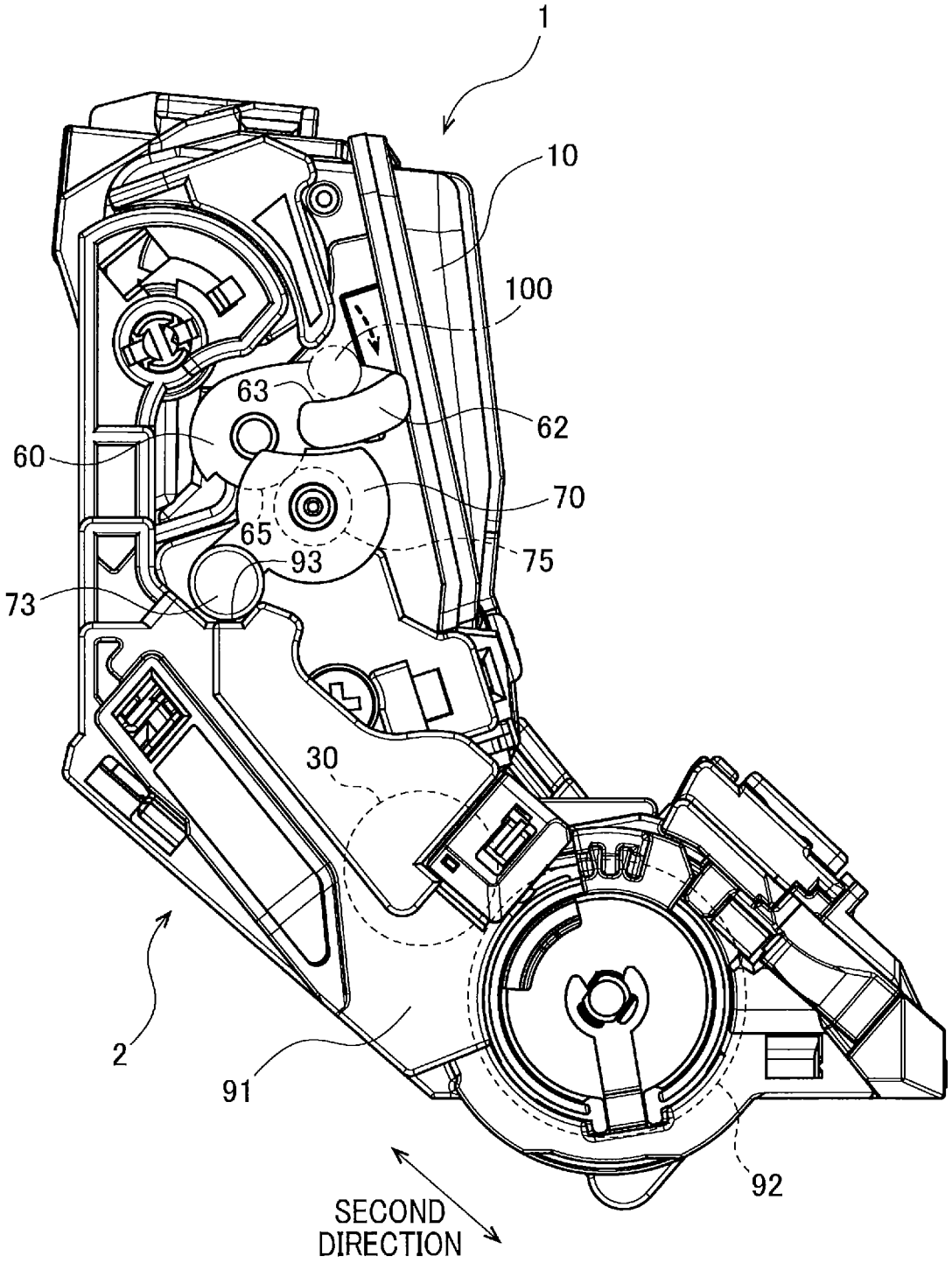
FIG. 9 is a plan view of the developing cartridge and the drum cartridge as viewed in the first direction, and particularly illustrating a state where the separating operation is performed.

The first cam 60 is rotatable, relative to the casing 10, about a first axis A1 extending in the first direction between a first position (illustrated in FIG. 8) and a second position (illustrated in FIG. 9).

Specifically, as illustrated in FIG. 3, the casing 10 includes a first cam shaft 16. The first cam shaft 16 extends in the first direction toward the cam cover 50 from the first outer surface 11 of the casing 10. The first cam shaft 16 has a solid cylindrical shape. The first cam shaft 16 extends in the first direction along the first axis A1. On the other hand, the first cam 60 has a first hole 61. The first hole 61 extends throughout a thickness of the first cam 60 in the first direction. The first cam shaft 16 is inserted in the first hole 61 such that the first cam 60 is rotatable relative to the first cam shaft 16. In this way, the first cam 60 is rotatably supported by the first cam shaft 16 so as to be rotatable about the first cam shaft 16.

As illustrated in FIGS. 4 and 5, the first cam 60 also includes a protrusion 62. The protrusion 62 is positioned radially outward of the first hole 61 centered on the first axis A1. Further, the protrusion 62 protrudes in the first direction from the first cam 60. Specifically, the protrusion 62 protrudes in a direction away from the casing 10 with respect to the first direction. The protrusion 62 has a pressure receiving surface 63. The pressure receiving surface 63 is configured to receive the pressing force from the image forming apparatus. The pressure receiving surface 63 has a curved concave surface, for example.

The protrusion 62 is positioned closer to the developing roller 30 in the second direction in a case where the first cam 60 is at the second position (illustrated in FIG. 9) than in a case where the first cam 60 is at the first position (illustrated in FIG. 8). Further, the protrusion 62 is positioned closer to the second cam 70 in the second direction in the case where the first cam 60 is at the second position than in the case where the first cam 60 is at the first position.

The first gear 65 illustrated in FIGS. 3, 4 and 6 is rotatable about the first axis A1 together with the first cam 60. The first gear 65 is positioned at the one end of the casing 10 in the first direction. Specifically, the first gear 65 is positioned at the first outer surface 11 of the casing 10. According to the present embodiment, the first cam 60 and the first gear 65 constitute a single component, i.e., the first cam 60 is integral with the first gear 65. However, the first cam 60 and the first gear 65 may be provided as two different components, as long as the first cam 60 and the first gear 65 are fixed to each other.

The first gear 65 has a plurality of first gear teeth (not illustrated). The first gear teeth are positioned at a part of an outer peripheral surface of the first gear 65. The first gear teeth are arrayed in a circumferential direction of the first gear 65 centered on the first axis A1. Each first gear tooth protrudes radially outward from the outer peripheral surface of the first gear 65. Incidentally, the first gear teeth may be positioned at the entire outer peripheral surface of the first gear 65.

The second cam 70 illustrated in FIGS. 3 through 6 is configured to make contact with the drum cartridge 2 to perform the separating operation (described later) in the state where the developing cartridge 1 attached to the drum cartridge 2 is attached to the image forming apparatus. The second cam 70 is positioned at the one end of the casing 10 in the first direction. Specifically, the second cam 70 is positioned at the first outer surface 11 of the casing 10. Further, the second cam 70 is positioned closer to the developing roller 30 than the first cam 60 is to the developing roller 30 in the second direction.

The second cam 70 is rotatable, relative to the casing 10, between a third position (illustrated in FIG. 8) and a fourth position (illustrated in FIG. 9) about a second axis A2 different from the first axis A1 and extending in the first direction.

Specifically, as illustrated in FIG. 3, the casing 10 includes a second cam shaft 17. The second cam shaft 17 extends in the first direction toward the cam cover 50 from the first outer surface 11 of the casing 10. The second cam shaft 17 has a solid cylindrical shape. The second cam shaft 17 extends in the first direction along the second axis A2.

Further, as illustrated in FIG. 4, the cam cover 50 includes a third cam shaft 51. The third cam shaft 51 extends in the first direction toward the casing 10 from a surface of the cam cover 50, the surface facing the casing 10. The third cam shaft 51 is solid cylindrical. The third cam shaft 51 extends in the first direction along the second axis A2.

On the other hand, the second cam 70 has a second hole 71. The second hole 71 extends throughout a thickness of the second cam 70 in the first direction. The second cam shaft 17 and the third cam shaft 51 are inserted in the second hole 71 such that the second cam 70 is rotatable about the second cam shaft 17 and the third cam shaft 51. Accordingly, the second cam 70 is rotatably supported by the second cam shaft 17 and the third cam shaft 51 so as to be rotatable about the second cam shaft 17 and the third cam shaft 51.

As illustrated in FIGS. 4 through 6, the second cam 70 has a notch 72. The notch 72 is concaved radially inwardly from an outer peripheral surface of the second cam 70 centered on the second axis A2. In the case where the first cam 60 is at the second position, a part of the protrusion 62 of the first cam 60 is positioned to face the notch 72 with a space therebetween, as illustrated in FIG. 9. Thus, the protrusion 62 of the first cam 60 is configured not to make contact with the second cam 70.

As illustrated in FIGS. 4 through 6, the second cam 70 also includes an acting portion 73. The acting portion 73 is positioned radially outward of the second hole 71 centered on the second axis A2. Further, the acting portion 73 protrudes in the first direction from the second cam 70. More specifically, the acting portion 73 extends in a direction away from the casing 10 with respect to the first direction.

The acting portion 73 is positioned closer to the developing roller 30 in the second direction in a case where the second cam 70 is at the fourth position (illustrated in FIG. 9) than in a case where the second cam 70 is at the third position (illustrated in FIG. 8). Further, the acting portion 73 is positioned farther from the first cam 60 in the second direction in the case where the second cam 70 is at the fourth position than in the case where the second cam 70 is at the third position.

The second gear 75 illustrated in FIGS. 3, 4 and 6 is rotatable about the second axis A2 together with the second cam 70. The second gear 75 is positioned at the one end of the casing 10 in the first direction. Specifically, the second gear 75 is positioned at the first outer surface 11 of the casing 10. According to the present embodiment, the second cam 70 and the second gear 75 constitute a single component, i.e., the second cam 70 is integral with the second gear 75. However, the second cam 70 and the second gear 75 may be provided as two different components, as long as the second cam 70 and the second gear 75 are fixed to each other.

The second gear 75 has a plurality of second gear teeth (not illustrated). The second gear teeth are positioned at an entire outer peripheral surface of the second gear 75 centered on the second axis A2. The second gear teeth are arrayed in a circumferential direction of the second cam 70 centered on the second axis A2. Each second gear tooth protrudes radially outward from the outer peripheral surface of the second gear 75. Incidentally, the second gear teeth may be positioned at a part of the outer peripheral surface of the second gear 75.

The second gear 75 is in contact with the first gear 65. Specifically, the second gear 75 is in meshing engagement with the first gear 65. More specifically, the second gear teeth of the second gear 75 are in meshing engagement with the first gear teeth of the first gear 65.

As illustrated in FIG. 5, as the first cam 60 rotates in a first rotational direction Y1 from the first position toward the second position, the first gear 65 also rotates about the first axis A1 in the first rotational direction Y1 together with the first cam 60. In accordance with the rotation of the first gear 65 about the first axis A1 in the first rotational direction Y1, the second gear 75 rotates about the second axis A2 in a second rotational direction Y2 opposite to the first rotational direction Y1 due to the meshing engagement between the first gear teeth and the second gear teeth. As such, the second cam 70 rotates from the third position to the fourth position.

Further, as the first cam 60 rotates in a third rotational direction Y3 from the second position toward the first position, the first gear 65 rotates about the first axis A1 in the third rotational direction Y3 together with the first cam 60. In accordance with the rotation of the first gear 65 about the first axis A1 in the third rotational direction Y3, the second gear 75 rotates about the second axis A2 in a fourth rotational direction Y4 opposite to the third rotational direction Y3 due to the meshing engagement between the first gear teeth and the second gear teeth. As such, the second cam 70 rotates from the fourth position to the third position.

Incidentally, each of the first gear 65 and the second gear 75 may include a material having a high friction coefficient such as rubber, instead of the gear teeth, so that the first gear 65 and the second gear 75 can engage each other to transmit rotations thereof using a frictional force generated therebetween.

2. Structure of the Drum Cartridge

Figure 7:
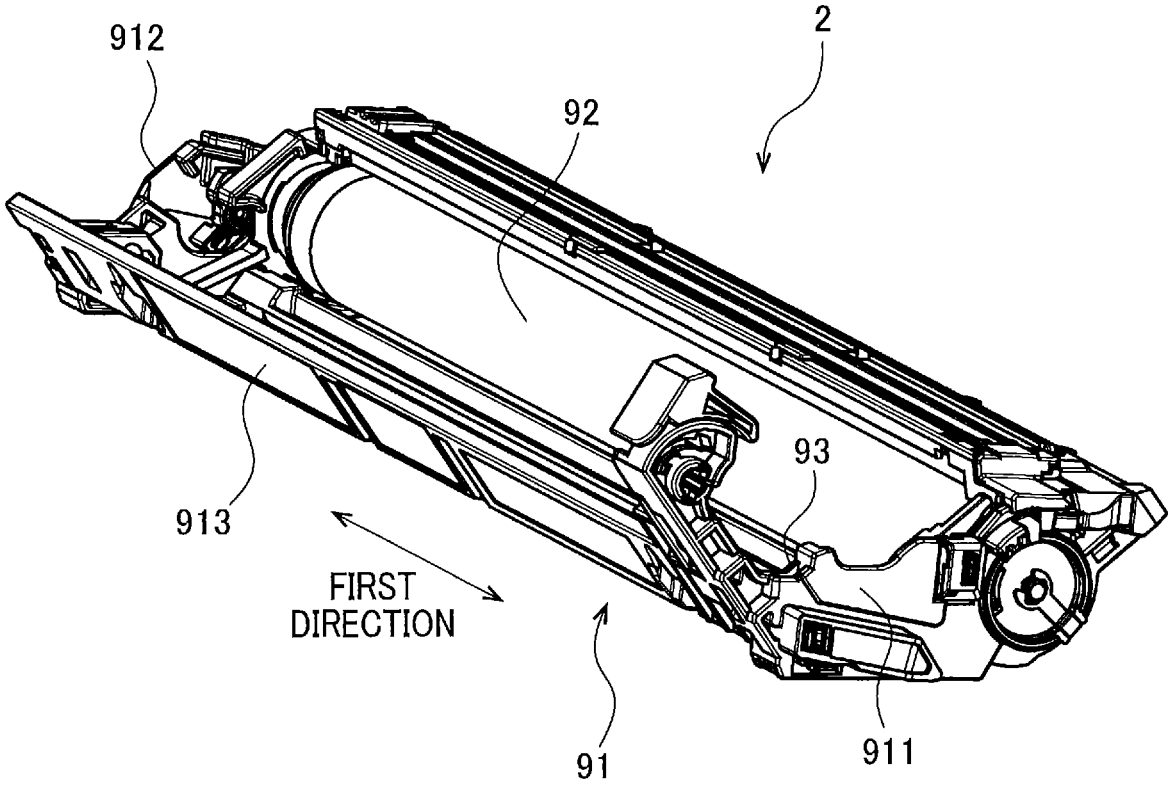
FIG. 7 is a perspective view of a drum cartridge.

FIG. 7 is a perspective view of the drum cartridge 2. As illustrated in FIG. 7, the drum cartridge 2 includes a drum frame 91 and the photosensitive drum 92. The developing cartridge 1 is attachable to the drum frame 91. The photosensitive drum 92 is hollow cylindrical and is rotatable about a rotation axis extending in the first direction. The outer peripheral surface of the photosensitive drum 92 is a surface covered with a photosensitive material. The photosensitive drum 92 is positioned at one end of the drum frame 91 in the second direction.

Upon attachment of the developing cartridge 1 to the drum frame 91, the developing roller 30 is urged toward the photosensitive drum 92 in the second direction by an urging force of an urging member (not illustrated). Accordingly, the outer peripheral surface of the developing roller 30 and the outer peripheral surface of the photosensitive drum 92 are in contact with each other.

The drum frame 91 includes a first drum frame 911, a second drum frame 912, and a connection frame 913. The first drum frame 911 is at one end of the drum frame 91 in the first direction. The second drum frame 912 is at another end of the drum frame 91 in the first direction. The connection frame 913 extends in the first direction to connect the first drum frame 911 to the second drum frame 912.

Upon attachment of the developing cartridge 1 to the drum frame 91, the casing 10 of the developing cartridge 1 is positioned between the first drum frame 911 and the second drum frame 912 in the first direction. Further, the first outer surface 11 of the casing 10 faces the first drum frame 911 in the first direction upon attachment of the developing cartridge 1 to the drum frame 91. Further, the second outer surface 12 of the casing 10 faces the second drum frame 912 in the first direction upon attachment of the developing cartridge 1 to the drum frame 91.

The drum frame 91 also has a recessed portion 93. The recessed portion 93 is positioned at the one end of the drum frame 91 in the first direction. Specifically, the first drum frame 911 has the recessed portion 93. The recessed portion 93 is recessed in the second direction toward the photosensitive drum 92 from an upper edge of the first drum frame 911. Upon attachment of the developing cartridge 1 to the drum frame 91, the recessed portion 93 is positioned between the acting portion 73 of the second cam 70 and the photosensitive drum 92, and the acting portion 73 of the second cam 70 faces the recessed portion 93 in the second direction (see FIG. 8).

3. Separating Operation

After the developing cartridge 1 attached to the drum cartridge 2 is attached to the image forming apparatus, a separating operation is configured to be performed at the developing cartridge 1 upon receipt of a driving force from the image forming apparatus. The separating operation is an operation to achieve a temporal separation of the developing roller 30 from the photosensitive drum 92. For example, the separating operation is performed at the developing cartridge 1 for each color other than black, in a case where monochromatic printing is to be performed in the image forming apparatus. However, the developing cartridge 1 for the color of black may be allowed to perform the separating operation.

FIG. 8 is a plan view of the developing cartridge 1 and the drum cartridge 2 as viewed in the first direction in a state where the separating operation is not performed. FIG. 9 is a plan view of the developing cartridge 1 and the drum cartridge 2 as viewed in the first direction in a state where the separating operation is performed. Note that the cam cover 50 is not delineated in FIGS. 8 and 9.

Upon attachment of the developing cartridge 1 to the drum cartridge 2, the developing cartridge 1 is at a contacting position where the surface of the developing roller 30 is in contact with the surface of the photosensitive drum 92. At this time, the first cam 60 is at the first position, and the second cam 70 is at the third position. When the second cam 70 is at the third position, the acting portion 73 of the second cam 70 is positioned away from the recessed portion 93 of the drum frame 91. Accordingly, the acting portion 73 does not press the recessed portion 93 of the drum frame 91.

The image forming apparatus includes a driver lever 100 which is indicated by a two-dotted chain line in FIGS. 8 and 9. The driver lever 100 is pivotally movable about a pivot axis extending in the first direction. For performing the separating operation, the image forming apparatus pivotally moves the driver lever 100 in a direction indicated by a broken arrow in FIG. 9. As a result, the driver lever 100 comes into contact with the pressure receiving surface 63 of the first cam 60 to press the pressure receiving surface 63 in the second direction toward the photosensitive drum 92. In response to the pressing force applied to the pressure receiving surface 63, the first cam 60 rotates about the first axis A1 relative to the casing 10 from the first position illustrated in FIG. 8 to the second position illustrated in FIG. 9.

As the first cam 60 moves from the first position to the second position, the first gear 65 also rotates together with the first cam 60 about the first axis A1 relative to the casing 10. In accordance with the rotation of the first gear 65, the second gear 75 rotates about the second axis A2 relative to the casing 10. In accordance with the rotation of the second gear 75, the second cam 70 rotates about the second axis A2, relative to the casing 10, from the third position illustrated in FIG. 8 to the fourth position illustrated in FIG. 9.

As the second cam 70 moves from the third position to the fourth position, the acting portion 73 of the second cam 70 is brought into contact with the recessed portion 93 of the drum frame 91 such that the acting portion 73 presses the recessed portion 93 in the second direction toward the photosensitive drum 92. Accordingly, the developing cartridge 1 moves in the second direction relative to the drum cartridge 2 in such a manner that a point of contact between the acting portion 73 and the recessed portion 93 functions as a fulcrum.

As a result, the casing 10 and the developing roller 30 of the developing cartridge 1 move in a direction away from the photosensitive drum 92 with respect to the second direction. The surface of the developing roller 30 is thus separated from the surface of the photosensitive drum 92. That is, the developing cartridge 1 moves from the contacting position to a separated position relative to the drum cartridge 2.

Incidentally, the developing cartridge 1 may further include a third cam, a third gear, a fourth cam, and a fourth gear (respectively corresponding to the first cam 60, the first gear 65, the second cam 70, and the second gear 75) at another end of the casing 10 in the first direction. In this case, the third cam, the third gear, the fourth cam, and the fourth gear may operate in the same manner as the first cam 60, the first gear 65, the second cam 70, and the second gear 75 by the driving force supplied from the image forming apparatus. Accordingly, the fourth cam can press the drum frame 91 in the second direction toward the photosensitive drum 92. With this structure, the developing roller 30 can move away from the photosensitive drum 92 in the second direction while a posture of the developing roller 30 is maintained in parallelism with the photosensitive drum 92.

4. Functions and Technical Advantages

In the structure of the present embodiment described above, the developing roller 30 can move in the direction away from the photosensitive drum 92 by the rotations of the first cam 60 and the second cam 70 provided at the developing cartridge 1. Hence, compared to a case where a cam for performing the separating operation is provided in the drum cartridge 2, the number of parts and components in the drum cartridge 2 can be reduced. Further, the pressing force supplied from the image forming apparatus can be transmitted directly to the developing cartridge 1 without the interposition of the drum cartridge 2. Accordingly, no part or component is required at the drum cartridge 2 for the transmission of the pressing force. Hence, the number of parts and components in the drum cartridge 2 can be reduced, and the drum cartridge 2 can be made compact. Further, since the first cam 60 and the second cam 70 for performing the separating operation can be provided at positions apart from the photosensitive drum 92, close positioning of the parts and components can be obviated to realize an efficient use in space at the developing cartridge 1 and drum cartridge 2.

Further, the first cam 60 is positioned farther away from the developing roller 30 than the second cam 70 is from the developing roller 30 in the second direction. With this structure, the first cam 60, which is configured to be applied with the pressing force, can be disposed at a position apart from the developing roller 30 and in the vicinity thereof where the parts and components are disposed densely, so that a region on the first outer surface 11 of the developing cartridge 1 can be effectively utilized.

<Variations And Modifications>

While the description has been made in detail with reference to the embodiments, it would be apparent to those skilled in the art that many modifications and variations may be made thereto.

For example, in the above-described embodiment, the developing cartridge 1 is configured to be attached to the drum cartridge 2 including a single photosensitive drum 92. Alternatively, the developing cartridge 1 may be attached to a drum cartridge including a plurality of photosensitive drums 92 (for example, a drawer including a plurality of photosensitive drums 92).

Further, shapes of detailed parts of the developing cartridge 1 may be different from those illustrated in the attached drawings. Further, the elements described in the above embodiment and modifications may be combined as appropriate, as long as no contradiction is incurred.

[Remarks]

The developing cartridge 1 is an example of a developing cartridge of the disclosure. The drum cartridge 2 is an example of a drum cartridge. The photosensitive drum 92 is an example of a photosensitive drum. The developing roller 30 is an example of a developing roller. The casing 10 is an example of a casing. The first cam 60 is an example of a first cam, and the second cam 70 is an example of a second cam. The first gear 65 is an example of a first gear, and the second gear 75 is an example of a second gear. The pressure receiving surface 63 is an example of a pressure receiving surface of the first cam. The protrusion 62 is an example of a protrusion of the first cam. The acting portion 73 is an example of an acting portion of the second cam. The recessed portion 93 is an example of a part of the drum cartridge. The first cam shaft 16 and the second cam shaft 17 are examples of a first cam shaft and a second cam shaft of the casing, respectively. The cam cover 50 is an example of a cover. The third cam shaft 51 is an example of a third cam shaft of the cover.

What is claimed is:

1. A developing cartridge attachable to a drum cartridge including a photosensitive drum, the developing cartridge comprising:

a developing roller rotatable about a developing axis extending in a first direction;

a casing configured to accommodate developing agent therein, the casing having one end in a second direction where the developing roller is positioned;

a first cam rotatable relative to the casing about a first axis extending in the first direction between a first position and a second position;

a first gear rotatable about the first axis together with the first cam;

a second cam rotatable relative to the casing about a second axis extending in the first direction between a third position and a fourth position; and a second gear rotatable about the second axis together with the second cam, the second gear being in contact with the first gear, wherein, in a state where the developing cartridge is attached to the drum cartridge, in a case where the first cam is at the first position, the second cam is at the third position to cause a surface of the developing roller and a surface of the photosensitive drum to contact each other, and wherein, in the state where the developing cartridge is attached to the drum cartridge, in a case where the first cam is at the second position, the second cam is at the fourth position to make contact with a part of the drum cartridge such that the developing cartridge moves relative to the drum cartridge in a direction to separate the surface of the developing roller from the surface of the photosensitive drum in such a manner that a point of contact between the second cam and the part of the drum cartridge functions as a fulcrum.

2. The developing cartridge according to claim 1, wherein the second gear is in meshing engagement with the first gear.

3. The developing cartridge according to claim 2, wherein the first gear has a plurality of first gear teeth, and wherein the second gear has a plurality of second gear teeth in meshing engagement with the first gear teeth.

4. The developing cartridge according to claim 1, wherein the first cam is rotatable about the first axis relative to the casing from the first position to the second position in response to receipt of a pressing force applied to the first cam.

5. The developing cartridge according to claim 4, wherein the first cam has a pressure receiving surface configured to receive the pressing force, the first cam being rotatable about the first axis relative to the casing from the first position to the second position in response to the pressing force applied to the pressure receiving surface.

6. The developing cartridge according to claim 5, wherein the first cam includes a protrusion having the pressure receiving surface, the protrusion protruding in a direction away from the casing with respect to the first direction.

7. The developing cartridge according to claim 6, wherein the second cam has a notch configured to face the protrusion in the case where the first cam is at the second position.

8. The developing cartridge according to claim 1, wherein the second cam includes an acting portion configured to contact the part of the drum cartridge and functioning as the fulcrum in the case where the second cam is at the fourth position in the state where the developing cartridge is attached to the drum cartridge.

9. The developing cartridge according to claim 8, wherein the acting portion extends in a direction away from the casing with respect to the first direction.

10. The developing cartridge according to claim 1, wherein the first cam and the second cam are positioned at one end of the casing in the first direction.

11. The developing cartridge according to claim 10, further comprising a cover fixed to the one end of the casing in the first direction and covering the first gear and the second gear.

12. The developing cartridge according to claim 11, wherein the casing includes a second cam shaft extending along the second axis, wherein the cover has a third cam shaft extending along the second axis, wherein the second cam has a hole extending in the first direction, and wherein the second cam shaft and the third cam shaft are inserted in the hole such that the second cam is rotatable about the second cam shaft and the third cam shaft.

13. The developing cartridge according to claim 1, wherein the casing includes a first cam shaft extending along the first axis and a second cam shaft extending along the second axis, wherein the first cam is rotatable about the first cam shaft, and wherein the second cam is rotatable about the second cam shaft.

14. The developing cartridge according to claim 1, wherein the first cam is positioned farther away from the developing roller than the second cam is from the developing roller in the second direction.

15. The developing cartridge according to claim 1, wherein the second direction crosses the first direction.

16. The developing cartridge according to claim 1, wherein the first cam includes the first gear.

17. The developing cartridge according to claim 1, wherein the second cam includes the second gear.

* * * * *